US005224888A

United States Patent [19]

Fujimoto et al.

[11] Patent Number: 5,224,888

[45] Date of Patent: Jul. 6, 1993

[54] BOAT PROPULSION ASSEMBLY

[75] Inventors: Hiroaki Fujimoto; Akihiro Onoue, both of Shizuoka, Japan

[73] Assignee: Sanshin Kogyo Kabushiki Kaisha, Japan

[21] Appl. No.: 894,333

[22] Filed: Jun. 4, 1992

[30] Foreign Application Priority Data

Jun. 6, 1991 [JP] Japan ..... 3-160760

[51] Int. Cl.[5] ..... B63H 5/12

[52] U.S. Cl. ..... 440/61; 248/641

[58] Field of Search ..... 440/53, 55, 56, 58-63, 440/900; 248/640, 641, 642

[56] References Cited

U.S. PATENT DOCUMENTS 3,164,122 1/1965 Fageol ..... 440/52

4,371,348 2/1983 Blanchard ..... 440/58

4,449,945 5/1984 Ferguson ..... 440/53

*Primary Examiner*—Jesus D. Sotelo

*Attorney, Agent, or Firm*—Bacon & Thomas

[57] ABSTRACT

A boat outboard propulsion assembly includes an engine 20 mounted on an engine support which, in turn, is secured to a swivel bracket adapted to be secured to a transom of a boat. Between the engine support and the engine, a steering bracket is provided which is attached to a propulsion unit that is pivotally supported by the engine support such that steering of the boat is accomplished by pivoting of the propulsion unit while the engine remains fixedly secured relative to the swivel bracket. The output drive shaft of the engine extends through the steering bracket and is connected to the propulsion unit. Engine exhaust gases are channeled through the steering bracket and the propulsion unit.

10 Claims, 3 Drawing Sheets

BOAT PROPULSION ASSEMBLY

BACKGROUND OF THE INVENTION

The present invention pertains to a boat propulsion assembly and more particularly to an outboard propulsion arrangement and an assembly for mounting the propulsion arrangement to a transom of a boat.

DESCRIPTION OF THE PRIOR ART

On small to mid-size watercraft, outboard engines are frequently used as propulsion devices. In such prior art arrangements, the engines are secured to the transom of the boat through a mounting assembly which permits pivoting of the engine relative to the boat about a horizontal axis so that the engine can be raised or lowered relative to the boat and about a vertical axis for steering purposes. U.S. Pat. No. 3,164,122 discloses an exemplary boat propulsion device according to the prior art. In this prior art arrangement, the engine and the propulsion unit are supported by a box structure which is mounted to the boat. The box structure permits the engine and propulsion unit to be tilted about a horizontal axis for tilting of the unit and pivoted about a vertical axis for steering purposes.

According to the prior art, when steering of the boat is desired, the entire engine and propulsion unit must be pivoted. Pivoting of both the engine and the propulsion unit requires a great deal of space in order to accommodate the turning of the engine. Therefore, there exists a need in the art for a boat propulsion assembly which can minimize the space required for steering operations.

SUMMARY OF THE INVENTION

It is an object of the present invention to minimize the amount of space required for steering a boat propulsion device, such as an outboard engine.

This and other objects of the present invention are achieved by providing a boat propulsion assembly having a propulsion assembly equipped with a clamp bracket affixed to the transom of a boat with a horizontal tilt shaft positioned at a top portion thereof, a swivel bracket which is pivotally supported by the clamp bracket via the tilt shaft, an engine including a support attached to a lower portion of the swivel bracket, a steering bracket positioned between the engine support and the engine, and a propulsion unit having a casing which is attached to the steering bracket such that the propulsion unit is freely pivotally supported by the engine support. The propulsion unit is linked to an output shaft of the engine by a drive shaft.

According to the invention, the engine is not pivoted with the propulsion unit during steering of the boat. As a result, when the engine is positioned outside the boat in an outboard configuration, the space which is required to accommodate steering of the outboard engine is minimized. Further objects and features of the invention will become more readily apparent from the following description of a preferred embodiment of the invention when taken in conjunction with the drawings wherein like reference numerals refer to corresponding parts in the several views.

DETAILED DESCRIPTION OF A PREFERRED EMBODIMENT

Figure 1:
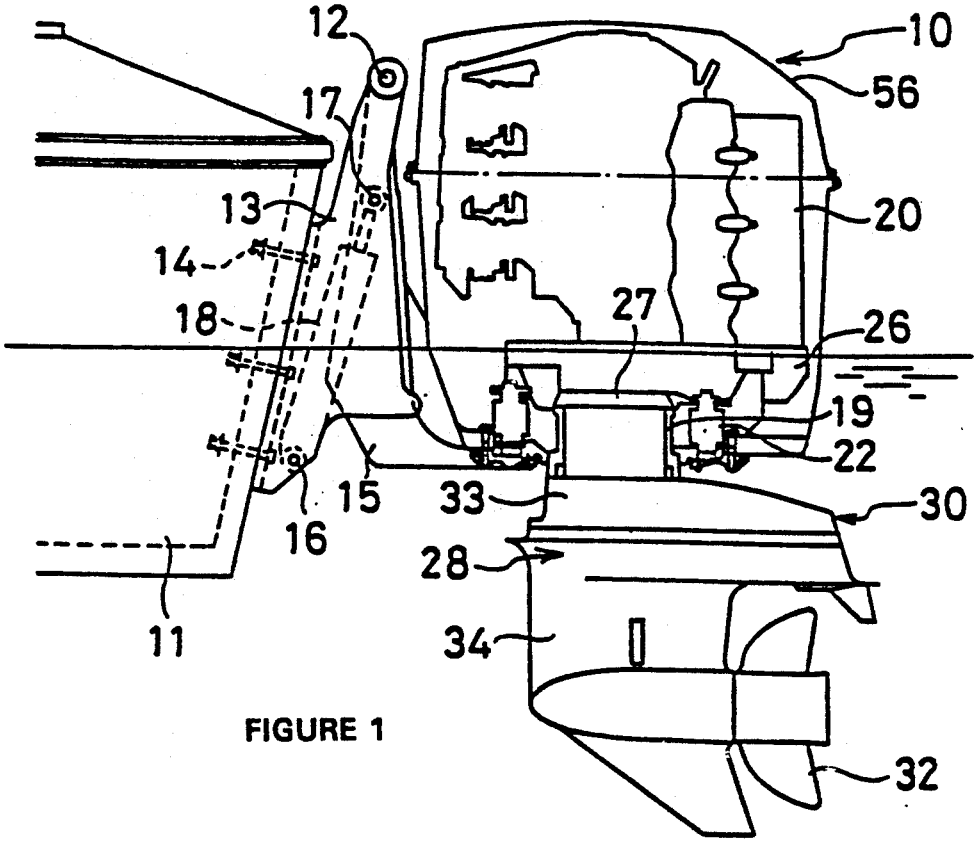
FIG. 1 is a schematic side view of the boat propulsion assembly according to the present invention.
Figure 2:
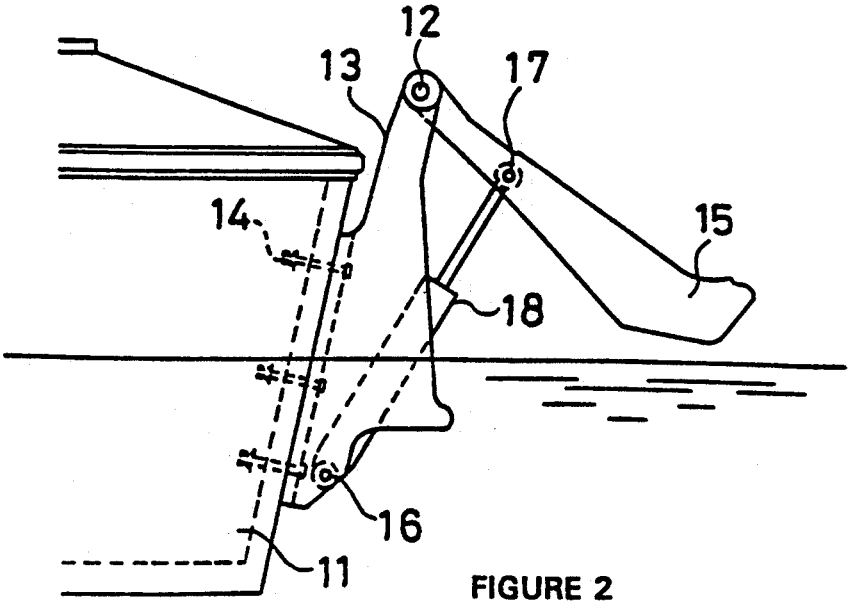
FIG. 2 depicts a schematic side view of the mounting arrangements for the propulsion assembly shown in FIG. 1 in an up-tilted position.
Figure 3:
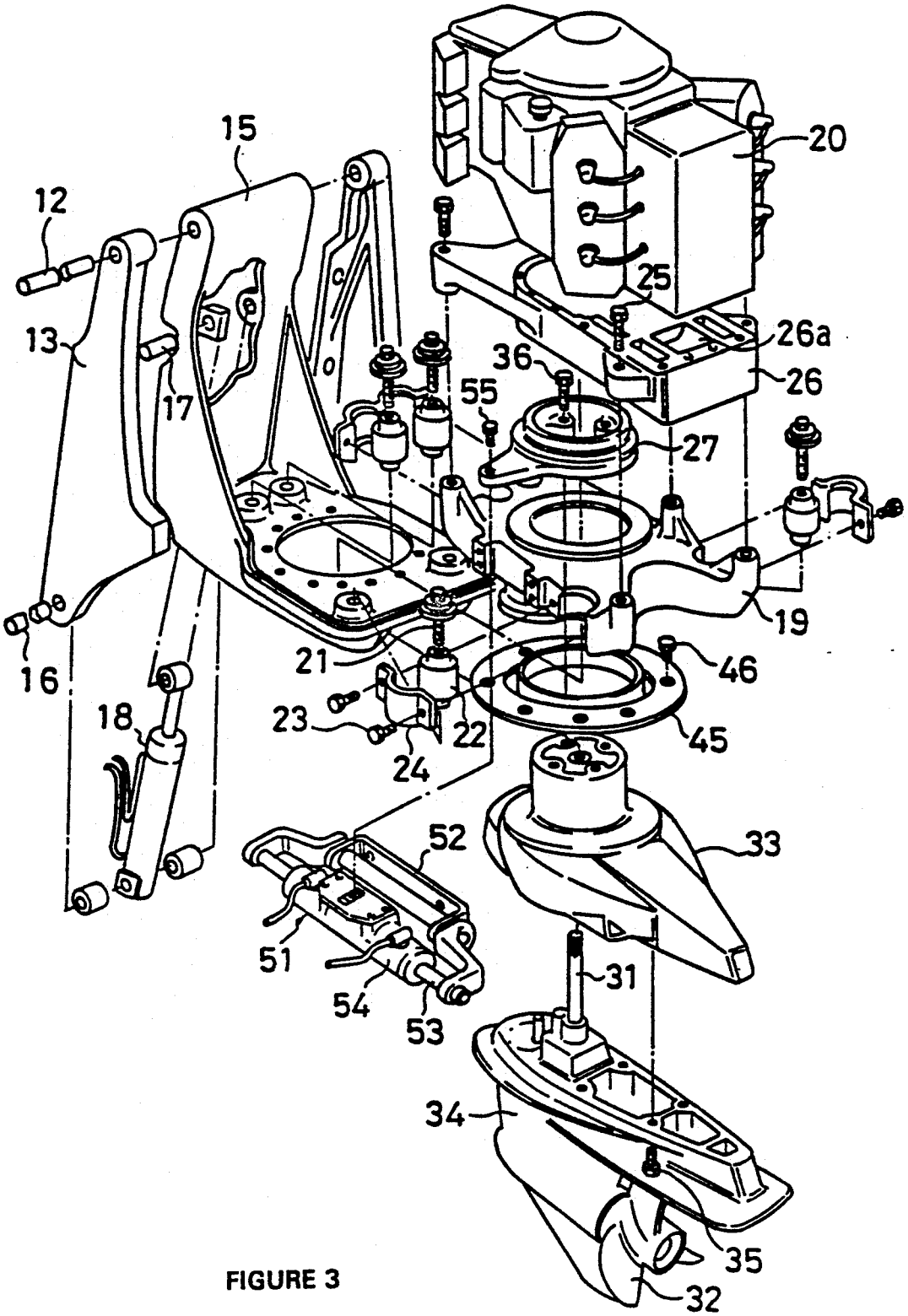
FIG. 3 shows an exploded view of the propulsion assembly according to the present invention.

As shown in FIGS. 1–4, the boat propulsion assembly 10 of the present invention is pivotally mounted to the transom of a boat 11 so as to be pivotable about a horizontal axis 12 with respect to a clamp bracket 13. Clamp bracket 13 is secured to the transom of boat 11 by means of a plurality of bolts 14. More particularly, boat propulsion assembly 10 is attached to a swivel bracket 15 which is pivotally mounted to clamp bracket 13 through tilt shaft 12. As best shown in FIG. 3, clamp bracket 13 includes a pair of spaced bracket walls (not individually labeled) between which swivel bracket 15 is located. Tilt shaft 12 is located at an upper portion of clamp bracket 13 and swivel bracket 15, which is substantially L-shaped, extends downward from its connection to clamp bracket 13 through tilt shaft 12 and rearward with respect to boat 11. Pins 16 and 17 are utilized to interconnect a tilt actuator 18 between clamp bracket 13 and swivel bracket 15. Tilt actuator 18 is generally known in the art and may comprise a hydraulic or pneumatic actuator which, when extended, functions to pivot swivel bracket 15 relative to clamp bracket 13 about tilt shaft 12 between a lower position generally shown in FIG. 1 and an upper position shown in FIG. 2.

Boat propulsion assembly 10 includes an engine 20 positioned on an upper side of an engine support 19 which, in turn, is attached to swivel bracket 15 as will be more fully discussed below. Engine support 19 includes a rubber mount 22 which is affixed to swivel bracket 15 by means of an attachment bolt 21. Rubber mount 22 is secured to engine support 19 by means of attachment bolts 23 and attachment bracket 24. As best shown in FIG. 3, four such rubber mounts are utilized in the preferred embodiment.

Engine 20 of boat propulsion assembly 10 is mounted on top of an exhaust baffle 26 which is affixed to a top part of engine support 19 by means of attachment bolts 25. As shown in FIG. 3, exhaust baffle 26 is equipped with an exhaust expansion chamber 26*a*.

Propulsion assembly 10 further includes a propulsion unit 30 which is composed of a steering bracket 27 positioned in a space between engine support 19 and engine 20. Propulsion assembly 10 further includes a propulsion casing 28 which is connected to steering bracket 27 in a manner which will be more fully described below. Propulsion unit 30 is also equipped with a drive shaft 31, a forward/reverse switch (not shown) and a propeller 32.

Figure 4:
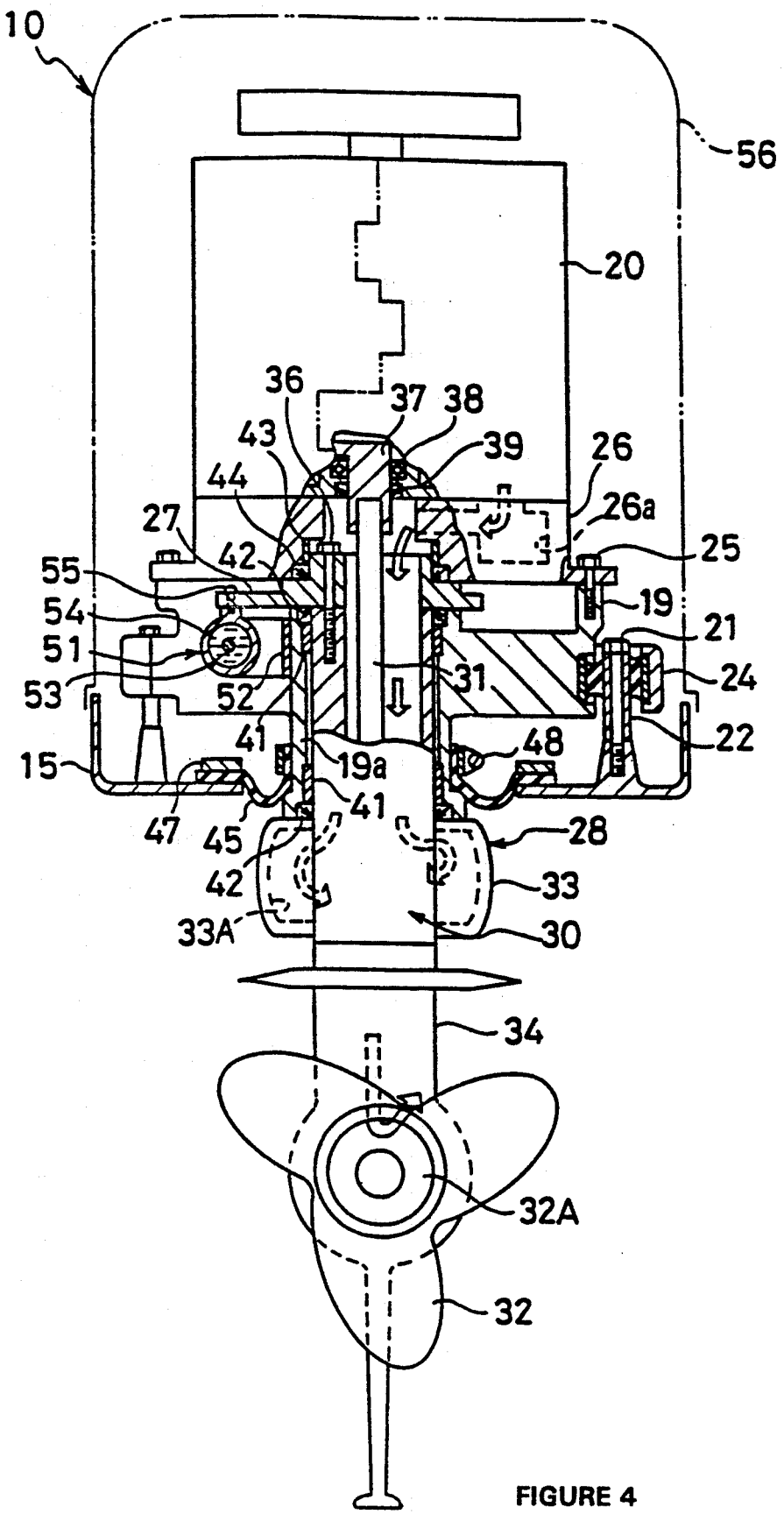
FIG. 4 depicts a rear, vertical cross-sectional view of the boat propulsion assembly of the present invention.

Propulsion casing 28 is comprised of an upper casing 33 and a lower casing 34. Upper and lower casings 33, 34 are secured together by means of bolts 35. Upper casing 33 is equipped with a second exhaust expansion chamber 33A and an exhaust gas outlet 32A is provided about propeller 32 as best shown in FIG. 4. Upper casing 33 of propulsion casing 28 is attached to steering bracket 27 through bolts 36 such that rotation of steering bracket 27 results in pivoting of propulsion casing 28. Therefore, propulsion unit 30 is pivotally supported upon engine support 19. An output shaft 37 of engine 20 is linked to drive shaft 31 of propulsion unit 30 by a spline connection which is shown in FIG. 3 but not labeled. Also provided are bearings 38 and an oil seal 39 around output shaft 37 of engine 20.

The specific manner in which propulsion unit 30 is supported with respect to engine support 19 will now be described in detail. Upper casing 33 of propulsion unit 30 is pivotally supported via upper and lower bushings 41 which are located in a through hole (not labeled) formed in a steering support 19*a* of engine support 19. Oil seals 42 are utilized at upper and lower locations of the through hole. The steering bracket 27 for propulsion unit 30 is freely pivotally supported by means of bushing 43 mounted within an exhaust passage formed in exhaust baffle 26. An oil seal 44 is positioned between bushing 43 and steering bracket 27 as shown in FIG. 4. It should be noted that bushing 43 is utilized to minimize the friction encountered upon pivoting of steering bracket 27. In this sense, it is also possible to eliminate the use of bushing 43 if adequate lubrication was supplied between steering bracket 27 and the through hole formed in exhaust baffle 26.

Steering support 19*a* of engine support 19 extends through a portion of swivel bracket 15. A seal 45 is located between steering support 19*a* and swivel bracket 15. The outer circumference of seal 45 is affixed to swivel bracket 15 by means of attachment bolts 46 and metal plate 47, while the inside circumference is affixed to the steering support 19*a* by means of clamp band 48. In order to accommodate a steering actuator 51, an attachment bracket 52 is provided on one side of engine support 19. Steering actuator 51 generally comprises a rod 53, attached to bracket 52, and a cylinder 54. Attachment bolt 55 links cylinder 54 of steering actuator 51 to steering bracket 27. In addition to the above structure, a cowling 56 can be utilized to cover engine 20 and is adapted to be removably attached to swivel bracket 15.

Next, the operation of the boat propulsion assembly 10 of the present invention will be described in detail. As previously, swivel bracket 15 can be used to tilt engine 20 and propulsion unit 30 relative to clamp bracket 13 by means of tilting actuator 18. FIG. 1 depicts the down-tilted position of propulsion assembly 10 and FIG. 2 depicts the up-tilted position.

During steering operations, rod 53 of steering actuator 51 is shifted relative to cylinder 54 to cause propulsion unit 30 to pivot around center steering support 19*a* of engine support 19. It should therefore be readily apparent that engine unit 20 is not pivoted during the steering operation. As a result, when engine unit 20 is mounted as an outboard engine on a boat 11, it is possible to conserve space which would normally be required if the engine had to pivot for steering purposes. This space around engine 20 can then be utilized for other purposes, for example by using it to hold large capacity mufflers or exhaust tuning equipment in order to improve engine performance.

In this boat propulsion assembly, the exhaust from engine 20 passes through the first exhaust expansion chamber 26*a* in the exhaust baffle 26 and then through the steering bracket 27 via the central opening that accommodates the output drive shaft, to a second exhaust expansion chamber 33*a* in the upper casing before being expelled from the exhaust opening 32*a* adjacent propeller 32 in propulsion unit 30.

Although described with respect to a particular embodiment of the invention, it should be readily understood that various changes and/or modifications can be made to the present invention without departing from the spirit of the invention. In general, the invention is only intended to be limited by the scope of following claims.

We claim:

1. A boat propulsion assembly adapted to be pivotally mounted to a transom of a boat comprising:

a clamping bracket adapted to be fixedly secured to a transom of a boat;

a swivel bracket pivotally secured to said clamp bracket for rotation about a generally horizontal axis;

an engine support fixedly secured to said swivel bracket;

an engine fixedly secured to said engine support, said engine connected to an output drive shaft;

a steering bracket mounted for rotation about the output drive shaft relative to said engine and engine support;

means for rotating said steering bracket relative to said engine support;

a propulsion unit attached to said steering bracket for rotation therewith, said propulsion unit connected to said output drive shaft.

2. A boat propulsion assembly as claimed in claim 1, wherein said steering bracket is positioned between said engine and said engine support.

3. A boat propulsion assembly as claimed in claim 1, wherein said swivel bracket includes first and second members which are arranged substantially perpendicular to one another so that said swivel bracket is substantially L-shaped, said first member being pivotally secured to said clamp bracket, said engine support being fixedly secured to said second member.

4. A boat propulsion assembly as claimed in claim 1, wherein said means for rotating said steering bracket comprises a steering actuator including a fixed portion secured to said engine support and a movable portion attached to said steering bracket.

5. A boat propulsion assembly as claimed in claim 1, wherein said engine support is secured to said swivel bracket by means of a plurality of elastomeric mounts.

6. A boat propulsion assembly as claimed in claim 1, wherein said propulsion unit includes a propeller connected to said drive shaft.

7. A boat propulsion assembly as claimed in claim 1, said steering bracket including an opening through which said output drive shaft extends.

8. A boat propulsion assembly as claimed in claim 7, including an exhaust gas passage in said steering bracket, and means for channeling engine exhaust gas through said exhaust passage.

9. A boat propulsion assembly as claimed in claim 8, wherein said channeling means comprises an exhaust baffle fixedly secured to the engine support between the engine and engine support, said exhaust baffle arranged to receive engine exhaust gas and to direct the exhaust gas to the exhaust gas passage in the steering bracket.

10. A boat propulsion assembly as claimed in claim 9, said propulsion unit including an exhaust gas duct in communication with said exhaust passage, and an exhaust gas outlet in communication with said exhaust gas duct.

* * * * *